US005765724A

United States Patent [19]

Amberg et al.

[11] Patent Number: 5,765,724

[45] Date of Patent: Jun. 16, 1998

[54] METHOD AND A REMOVAL UNIT FOR EMPTYING A CONTAINER FILLED WITH A THIXOTROPIC PASTE

[75] Inventors: Guenther Amberg, Neuss; Wolfgang Huber, Fridolfing, both of Germany

[73] Assignee: Henkel-Ecolab GmbH & Co OHG, Duesseldorf, Germany

[21] Appl. No.: 732,258

[22] PCT Filed: Apr. 18, 1995

[86] PCT No.: PCT/EP95/01434

§ 371 Date: Oct. 28, 1996

§ 102(e) Date: Oct. 28, 1996

[87] PCT Pub. No.: WO95/29282

PCT Pub. Date: Nov. 2, 1995

[30] Foreign Application Priority Data

Apr. 27, 1994 [DE] Germany ..... 44 14 708.2

[51] Int. Cl.[6] ..... B67B 7/00

[52] U.S. Cl. ..... 222/1; 222/101

[58] Field of Search ..... 134/42, 25.2, 8, 134/184, 195, 201; 252/8.6, 90; 221/64, 65; 222/92, 93, 95, 251, 101, 1

[56] References Cited

U.S. PATENT DOCUMENTS 4,087,831 5/1978 Bendoni ..... 354/304
4,889,644 12/1989 Amberg et al. ..... 252/8.9

FOREIGN PATENT DOCUMENTS 445 046 9/1991 European Pat. Off. .
42 18 297 10/1993 Germany .

*Primary Examiner*—Jeffrey Stucker
*Attorney, Agent, or Firm*—Ernest G. Szoke; Wayne C. Jaeschke; Frank E. Robbins

[57] ABSTRACT

A method for emptying a substantially, completely compressible container filled with a thixotropic paste, for example, a paste-form detergent. The thixotropic paste is transported by compression by a compressive force of the container toward an opening of the container and through that opening into a connected delivery tube. The compressive force is applied to a limited area of the container to deliver the thixotropic paste which is then transported by a metering pump through the delivery tube to a mixing container where it is mixed with inflowing water.

28 Claims, 8 Drawing Sheets

METHOD AND A REMOVAL UNIT FOR EMPTYING A CONTAINER FILLED WITH A THIXOTROPIC PASTE

FIELD OF THE INVENTION

This invention relates to a method for emptying a substantially completely compressible container filled with a thixotropic (pseudoplastic) paste, more particularly a paste-form detergent. The container is more particularly a bag of a flexible material.

BACKGROUND OF THE INVENTION

Paste-form, substantially water-free detergents are mainly used in institutional laundries. Examples of such pastes are described in DE 38 26 110 A1 and in DE 37 19 906 A1. Their advantages lie in their high washing power by virtue of the high concentration of washing-active components in relation to powder-form detergents because non-washing-active additives serving merely to condition the detergent are not necessary in their case.

However, problems are posed by the physical properties of the pastes, namely their high viscosity and, in particular, their thixotropic (pseudoplastic) behavior which is an obstacle to easy emptying and metering of the paste. By thixotropy is meant the reduction in viscosity which occurs when the paste is stirred, shaken or otherwise sheared and the subsequent gradual increase in the viscosity of the unmoved paste. At room temperature, the viscosity of the above-mentioned pastes is so high that they are not able to flow from the storage container—or not in the time and quantity necessary for the intended application—under the sole influence of gravity.

Methods and devices for removing detergent pastes from containers are described inter alia in DE 37 19 906 A1, in DE 38 26 110 A1 and in German Utility Model G 93 14 591. According to this prior art, a drum is used as the storage container for the paste-form detergent. A plate ("follower plate") which is designed to move in the drum, extending up to the wall thereof, applies pressure to the paste and enables it to be transported by pump through a simple tube (DE 37 19 906 A1 and DE 38 26 110 A1). This emptying method is suitable for pastes with a viscosity of around 75,000 to 90,000 mPa.s. For pastes with higher viscosities, for example from 150,000 to 250,000 mPa.s, G 93 14 591 proposes a stirrer beneath the follower plate which liquefies the paste under the follower plate and thus makes it easier to dispense.

These known emptying methods and devices are designed for drums, i.e. relatively large containers. They are also suitable in principle for emptying relatively small paste containers holding up to about 30 kg but are uneconomical in this case. In addition, there is the further cost factor that, to avoid packaging waste, the drums have to be cleaned and returned to the detergent manufacturer. In the case of small containers, the cost of reusable containers is particularly high measured against the holding capacity of the container. On the other hand, however, economic reuse or recycling of the container should be possible in their case, too.

A device for substantially completely emptying flexible disposable containers filled with fluids is known from DE 42 18 297 A1. The relatively flat bag of wedge-shaped cross-section has an upper outlet opening. For emptying, it is placed between two plates and the outlet opening is connected to a tube. By means of a pressure cylinder, the plates are moved towards one another and the fluid accommodated in the container is squeezed out.

However, this emptying method is unsuitable for bags filled with thixotropic pastes because the pressure acting over the entire upper surface of the container is generally not sufficient for completely and sufficiently liquefying the paste. Accordingly, where this method is applied to bags filled with the above-mentioned paste, only part of the paste can be emptied. A large proportion of the paste remains in the container.

The problem addressed by the present invention was to develop a method for substantially completely emptying small inexpensive containers without the operator coming into contact with the product. In addition, the packaging problem mentioned above was to be economically solved. It was also to be possible to carry out the method with a relatively small device that would be inexpensive to make and operate.

SUMMARY OF THE INVENTION

According to the invention, the solution to this problem is characterized in that, beginning at one end of the container, shear forces are applied to the paste and, at the same time or thereafter, one wall of the container is pressed onto the opposite container wall so that the paste is pressed towards the opening.

The method according to the invention is not only suitable for emptying the container, but—in a preferred embodiment—may also be used for metering the thixotropic paste. Accordingly, it is proposed that, during emptying, the paste is metered, more particularly into a mixing container for mixing with water. After mixing of the detergent paste, a concentrated solution is obtained and may be used as stock liquor in the institutional laundry.

The present invention also relates to a unit for removing and, in particular, for metering thixotropic pastes from their containers provided with an opening, the unit comprising a baseframe and means for applying shear forces to the paste. The unit is preferably used for removing and metering highly viscous detergent pastes used in institutional laundries and is designed accordingly.

DETAILED DESCRIPTION OF THE INVENTION

The method according to the invention is not only suitable for emptying the container, but—in a preferred embodiment—may also be used for metering the thixotropic paste. Accordingly, it is proposed that, during emptying, the paste is metered, more particularly into a mixing container for mixing with water. After mixing of the detergent paste, a concentrated solution is obtained and may be used as stock liquor in the institutional laundry.

The shear forces may be applied to the paste and, at the same time or thereafter, the container walls may be pressed together by various means. For example, a plate provided with slots may be used, in which case the flexible container is drawn through the slots beginning at the end opposite the opening. Other means capable of simultaneously applying sufficiently strong shear forces and compressive forces towards the opening may also be used. For example, a vertical plate may be pushed across the container or a bag-like container may be rolled up like a tube beginning at the end opposite the opening. In either case, it is important to ensure that, on the one hand, a sufficient reduction in viscosity and, on the other hand, substantially complete emptying are obtained.

In one particularly advantageous embodiment of the invention, the shear forces are applied to the paste and the paste is simultaneously pressed towards the opening by means of a roller.

There are no limitations to the choice of material for the container. The only requirement is that flexibility is sufficient to be able to press the walls of the container together. In one particular embodiment, the container consists of polyethylene. A container of polyethylene is inexpensive and very flexible and, after emptying, the material may be reused as a raw material for other polyethylene parts. The necessary cleaning may readily be carried out by slitting the bag open and washing it in the washing machine separately or together with laundry. An additional advantage lies in the fact that all the detergent paste is used.

The present invention also relates to a unit for removing and, in particular, for metering thixotropic pastes from their containers provided with an opening, the unit comprising a baseframe and means for applying shear forces to the paste. The unit is preferably used for removing and metering highly viscous detergent pastes used in institutional laundries and is designed accordingly.

To solve the problem stated above, the containers are flexible disposable bags and the unit comprises means for compressing the bag over a limited area and towards the opening so that shear forces are applied to the paste over that area and, at the same time, the paste is transported towards the opening.

These means may differ in design. The only important requirement is that they should be capable of applying such strong shear forces that the viscosity of the paste is sufficiently reduced and the paste is transported towards the opening. In one particularly advantageous embodiment of the invention, the means applying the shear forces to the paste are in the form of a roller which is designed to move towards the opening of the bag and, at the same time, to press the walls of the bag together. Accordingly, the roller gradually moves towards the opening from the other end of the bag and, at the same time, renders the paste flowable in the vicinity of the roller. According to the invention, the roller may be motor-driven. However, if the paste is not only to be removed from the container, but also metered, the roller must move at a speed corresponding to the quantity of paste to be metered. In this case, control of the roller drive is advisable.

However, a non-motor-driven roller is preferred because problems with the drive and control system are thus ruled out. Accordingly, the invention proposes an inclined flat plate for accommodating the bag with a connection to the opening of the bag at the lower end of the plate and a free-moving roller sufficiently wide and heavy to press the walls of the bag together. The roller is disposed initially at the higher end of the inclined plate, and when it moves toward the lower end of the plate, squeezes the paste toward the bag opening and, at the same time, presses the emptied bag flat so that even small residues are transported to the opening of the bag. A minimum weight of the roller, typically around 20 to 25 kg for standard containers, is necessary on the one hand to ensure that sufficient weight to make the paste flow is applied and, on the other hand, to stop the roller from moving over the still full part of the bag. The width of the roller corresponds at least to the width of the bag.

The major advantage of the free-moving roller is that it applies the required pressure and the required shear forces and, at the same time, moves over the bag at a speed adapted to the required emptying rate, particularly in cases where the metering pump described hereinafter is used, without any need for complicated control mechanisms.

In another advantageous embodiment of the invention, the removal unit comprises a delivery tube for the paste. It is designed to be connected to the bag through an inlet opening. Even when relatively high pressures prevail in the bag, the container is sealingly connected to the removal unit during compression of the bag by a connecting element of the inlet opening of the delivery tube which is designed to be releasably but sealingly connected to the opening of the bag, as in FIG. 2. To this end, the embodiment in question is characterized in particular by an undercut provided at the opening of the bag and by a plate designed to be fixed to the removal unit and to be inserted into the undercut.

Slipping of the bag during the removal of the paste is easily and reliably prevented by the provision of spikes at that end of the removal unit situated opposite the inlet opening. That end of the bag opposite the opening generally has a sufficiently wide weld seam in which the spikes are able to engage and thus to fix the bag in the removal unit, for example on the inclined plate, at its upper end.

In the paste-filled bag lying on a supporting surface of the removal unit, the weld seam mentioned is situated at a distance from that surface which corresponds to about half the thickness of the bag. However, shortly after the beginning of the bag emptying process, the weld seam lies directly on the supporting surface. Problem-free engagement of the spikes in the weld seam and safe fixing of the bag in place throughout the emptying process, during which the distance of the weld seam from the supporting surface gradually decreases, are guaranteed by a clamping plate for the end of the bag which is situated at a distance from the supporting surface of the removal unit, for example from the inclined plate, and near that end opposite the inlet opening, and which is provided with one or more spikes, being designed to move towards the supporting surface with progressive emptying of the bag. In one particularly simple and effective embodiment, the clamping plate is fixed by springs to the supporting surface for the bag.

If the unit according to the invention is used not only to remove but also to meter the paste, one particularly advantageous embodiment of the invention is characterized by the provision of a pump in the delivery tube which is fixedly connected to the supporting surface, for example the inclined plate, or to the baseframe. If the supporting surface is designed to pivot in relation to the baseframe, it is of advantage—for reducing the weight of the moving parts—for the pump to be fixed to the baseframe and not to the supporting surface. The pump takes in the paste from the vicinity of the bag opening and the above-mentioned means for compressing the bag, for example the roller, squeezes the paste from the rear of the bag forward to the opening thereof and, at the same time, makes the paste flowable.

In one particular embodiment of the invention, means are provided to maintain a distance between the lower and the upper walls of the bag in the vicinity of the inlet opening of the delivery tube so that, even if the compression means and the pump are not optimally coordinated in operational terms, the upper wall of the bag is not sucked onto the lower wall of the bag which would interrupt the emptying and metering process. The distance means are preferably pressed automatically into the opening of the bag when the bag is introduced into the removal unit.

Several pumps may be used. Peristaltic pumps and gear pumps are mentioned as examples. However, the pump is preferably a screw pump and more preferably an eccentric screw pump.

Handling of the removal unit according to the invention where it is provided with the inclined plate as a supporting surface for the bag is greatly simplified if means are provided to move the spikes towards the clamping plate for the end of the bag and a holder is provided for the roller to enable the roller to be released when the spikes are moved towards the clamping plate. In a single step, the bag is fixed on the inclined plate and the roller is automatically brought into its starting position.

In addition, it is of particular advantage for the inclined plate to be moved into its starting position in the same step. Accordingly, the removal unit comprises means for pivoting the inclined plate to the required inclination, which means are designed for actuation simultaneously with the movement of the spikes and the release of the roller. If a metering pump, for example the screw pump already mentioned, is provided, it is advantageously arranged on or beneath the inclined plate. Blockage of the delivery tube through overly long delivery paths is thus avoided. In one particularly preferred embodiment of the removal unit with a pivotal inclined plate, the pump is not fixed to the inclined plate, but—as already mentioned—to the non-movable baseframe in order to minimize the overall weight of the inclined plate.

The following problem often arises in the final phase of the emptying process. The remaining contents of the bag are pushed along the supporting surface beyond the bag opening so that the roller stops between this residue and the bag opening, and the roller is unable to squeeze the remaining product into the delivery tube. The expansion of the bag walls during the emptying process is one reason for this problem. To solve the problem, the inlet opening of the delivery tube is designed for displacement relative to the supporting surface, optionally together with the connected pump, and is thus able to follow the movement of the bag opening caused by the expansion of the bag walls. It is particularly favorable if the pump together with the connected delivery tube is able to pivot freely to a certain extent. In addition, a spring may be provided to urge the inlet opening of the delivery tube in the required direction. Instead of making the pump pivotal, the problem may be solved by making the inlet opening flexible, for example in the form of a hose.

In one particularly inexpensive and robust embodiment, FIG. 4, the holder for the roller is in the form of an open box. When the spikes penetrate into the weld seam of the bag, the roller rolls out of the box into its intended position on the end of the bag.

In another advantageous embodiment, FIG. 5, the removal unit comprises another container in which the delivery tube for the paste and a water inlet terminate. In this container, the paste is mixed with water entering through the water inlet to form a stock liquor which may readily be pumped into the washing machines of the laundry. There is no longer any need for the stock liquor container typically encountered in the prior art.

In addition, a conductivity sensor connected to the outlet of the other container and linked to an indicator may be provided to facilitate and further simplify handling. The conductivity sensor measures the concentration of the aqueous solution and transmits a signal to the indicator, for example a buzzer and/or an indicator lamp, when the bag is completely empty and only water flows from the mixing container.

One example of embodiment of the invention is described in detail in the following with reference to the accompanying drawings, wherein:

FIG. 1 schematically illustrates one embodiment of the invention.

FIG. 2 is a fragmentary section, on an enlarged scale, in a vertical plate through the removal unit shown in FIG. 1, in the vicinity of the inlet of the delivery tube.

FIG. 3 schematically illustrates a removal unit similar to the unit shown in FIG. 1, before the introduction of a paste-filled bag.

Figure 7:
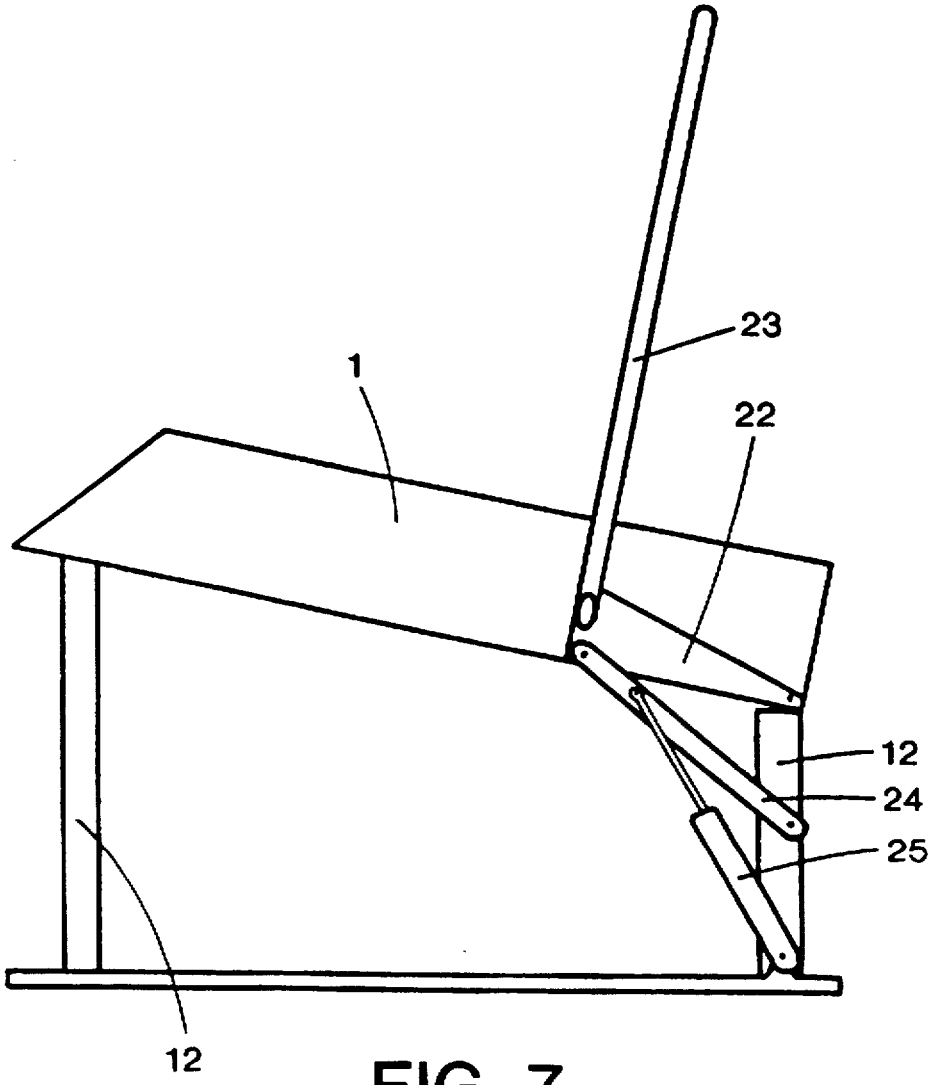

FIG. 7 schematically illustrates the pivoting drive in the removal unit shown in the previous FIGS. before the insertion of a bag.

Figure 8:
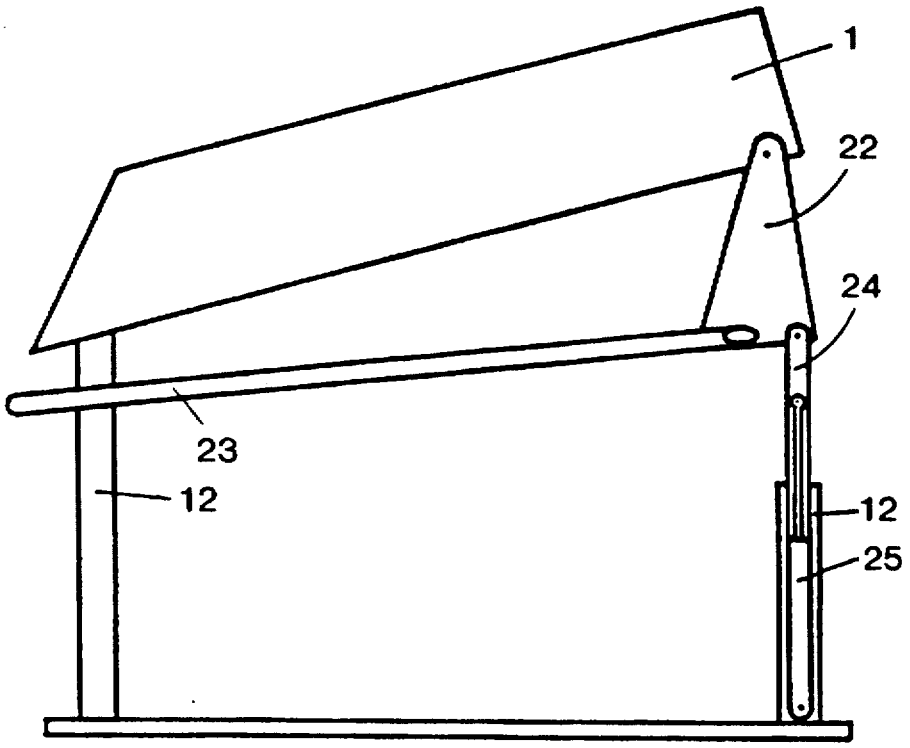

FIG. 8 is a schematic illustration of the unit shown in FIG. 7, after the insertion of a bag and after movement to place the roller in its operative position.

DESCRIPTION OF THE PREFERRED EMBODIMENT

Figure 1:
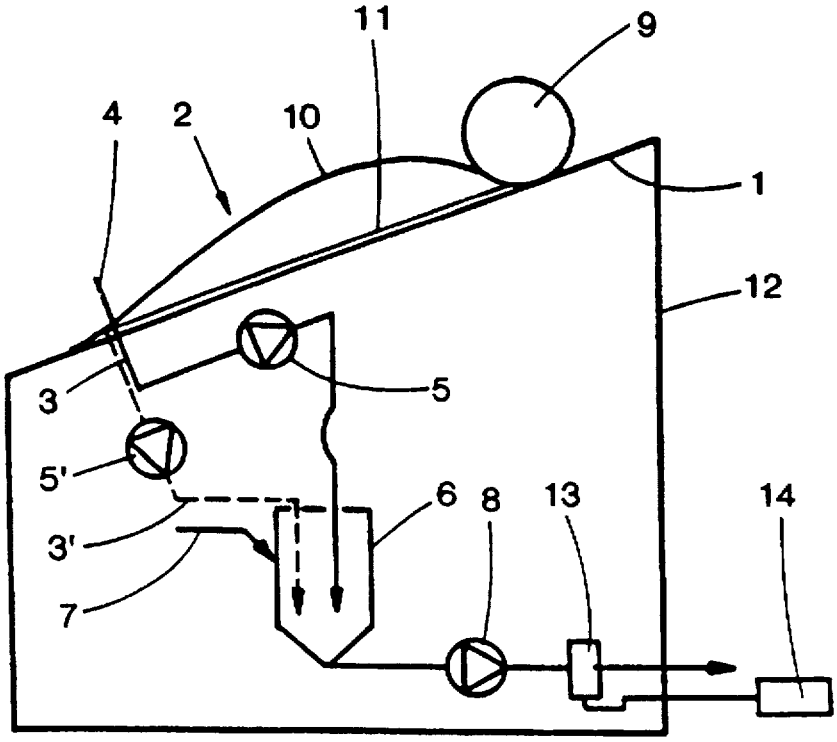

A flexible bag 2 of polyethylene which is filled with detergent paste, and which is formed with an opening 4 connected to a delivery tube 3, lies on the inclined plate 1 shown in FIG. 1 of a paste dispenser according to the invention. The paste dispenser comprises a rigid baseframe 12 in relation to which individual parts, for example the inclined plate 1, may be displaceable, as explained in more detail hereinafter.

An eccentric screw pump 5 serving as a metering pump takes in the paste from the bag 2 and delivers it into a mixing container 6. The metering pump 5 may be fixed to the inclined plate 1. However, where the inclined plate 1 is displaceable, the metering pump 5' is preferably fixed to the base frame 12 of the paste dispenser to minimize the weight of the inclined plate 1. This variant is shown in dashed lines in FIG. 1. In this case, the delivery tube is denoted by the reference 3'.

A roller 9 lying at the upper end of the inclined plane 1 presses the upper wall 10 of the bag onto the lower wall 11 of the bag so that shear forces are applied to the paste and, at the same time, the paste is pushed toward a pipe having an opening 4 into which the paste can flow, to ensure that the metering pump 5 is continuously supplied with product.

In the mixing container 6, the paste is mixed with water flowing in through another pipe 7 to form a stock liquor which is transported by a second pump 8 into the washing machines (not shown) of the laundry. The concentration of the stock liquor is monitored by a conductivity sensor 13. In the event of a reduction in the conductivity of the liquor transported by the pump 8 and hence in the event of a reduction in concentration, an optical and acoustic signal is emitted from the indicator 14. The main function of the conductivity sensor 13 in conjunction with the indicator 14 is to indicate when the bag 2 is empty, but also to indicate malfunctions.

Figure 2:
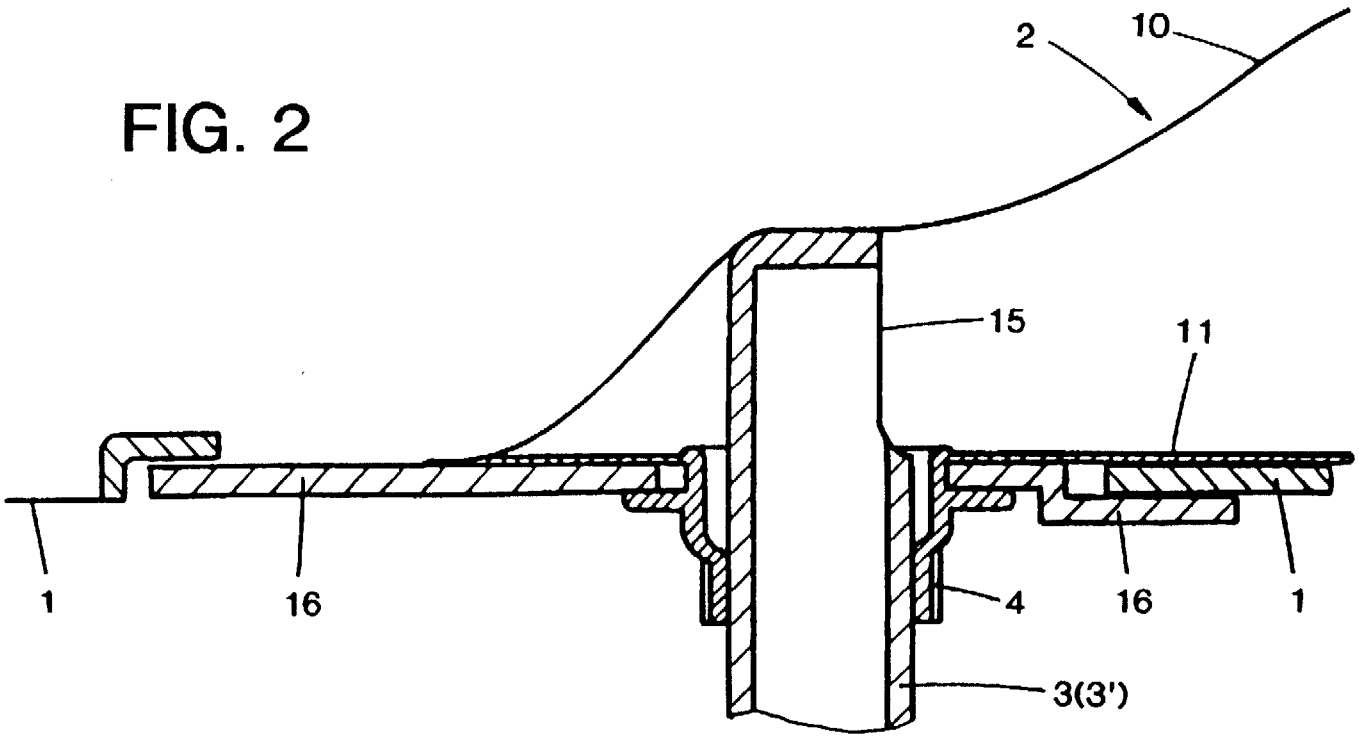

FIG. 2 is a vertical, fragmentary section through the inlet 15 of the delivery tube 3 or 3' which is inserted into the opening 4 of the bag 2. The flexible opening 4 of the bag 2, adapted to communicate with the delivery tube 3, guarantees a tight and safe connection. The inlet 3 has an opening 15 directed towards the end of the bag, i.e. to the right in FIG. 2, and the inlet pipe 3 projects into the bag 2 in order reliably to prevent the inlet opening 15 from being closed by the upper wall 10 of the bag, even where the metering pump 5, 5' has a high suction capacity. The inlet pipe 3 thus acts as a spacer element for maintaining an adequate communication and paste flow.

A plate 16 with an open recess on one side is used to insert the bag 2 into the paste dispenser. The portion of the bag above this opening 4 is pushed into this recess so that the plate 16 is held firmly in an undercut adjacent the opening 4. The plate 16 fixed to the bag 2 is then arranged on the inclined plate, as shown in FIG. 2. The bag opening 4 is positioned firmly and safely on the inclined plate despite the severe mechanical stressing of the bag by the roller 9 and the suction pressure of the metering pump 5, 5'.

In one preferred embodiment, the plate 16 is displaceable along the inclined plate 1 (to the left in FIG. 2) together with the opening 4 of the bag 2 and the inlet of the delivery tube 3, 3' in order to compensate for the expansion of the bag 2 attributable to its mechanical stressing, as explained above.

Figure 3:
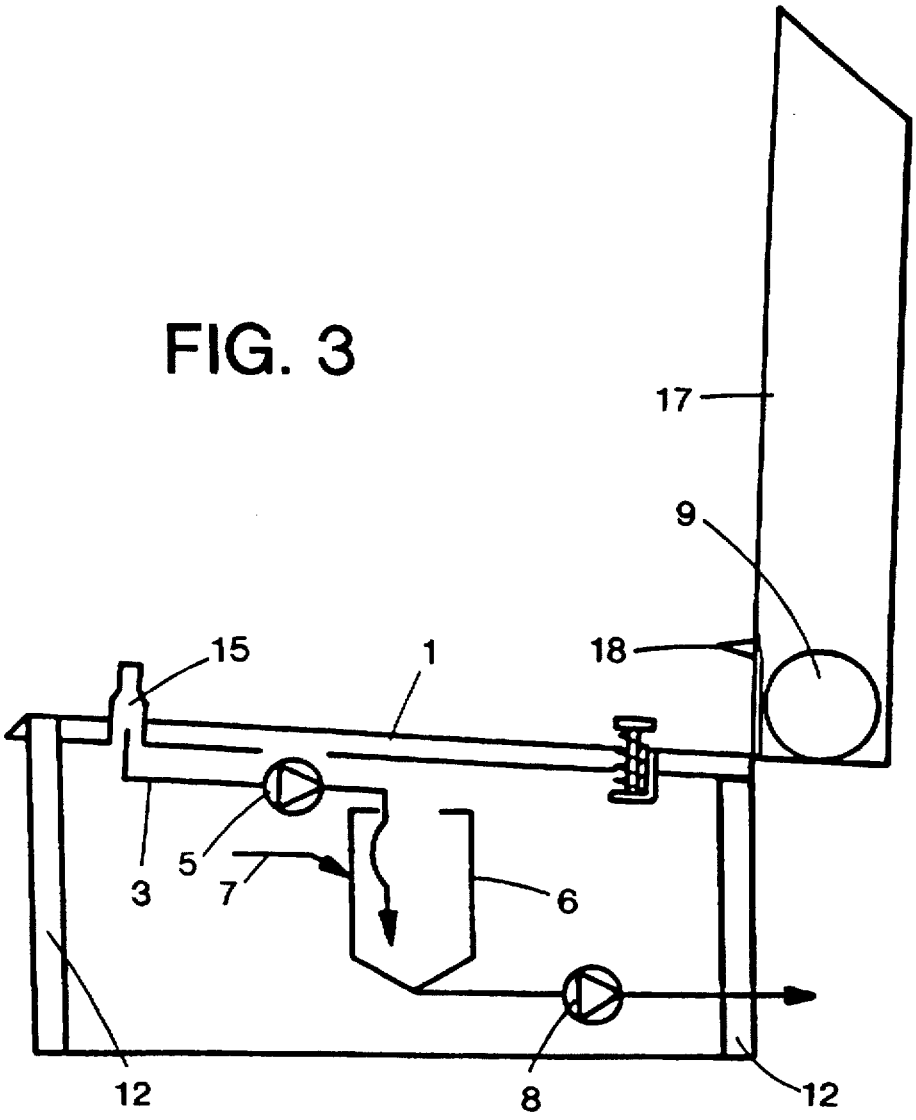
Figure 4:
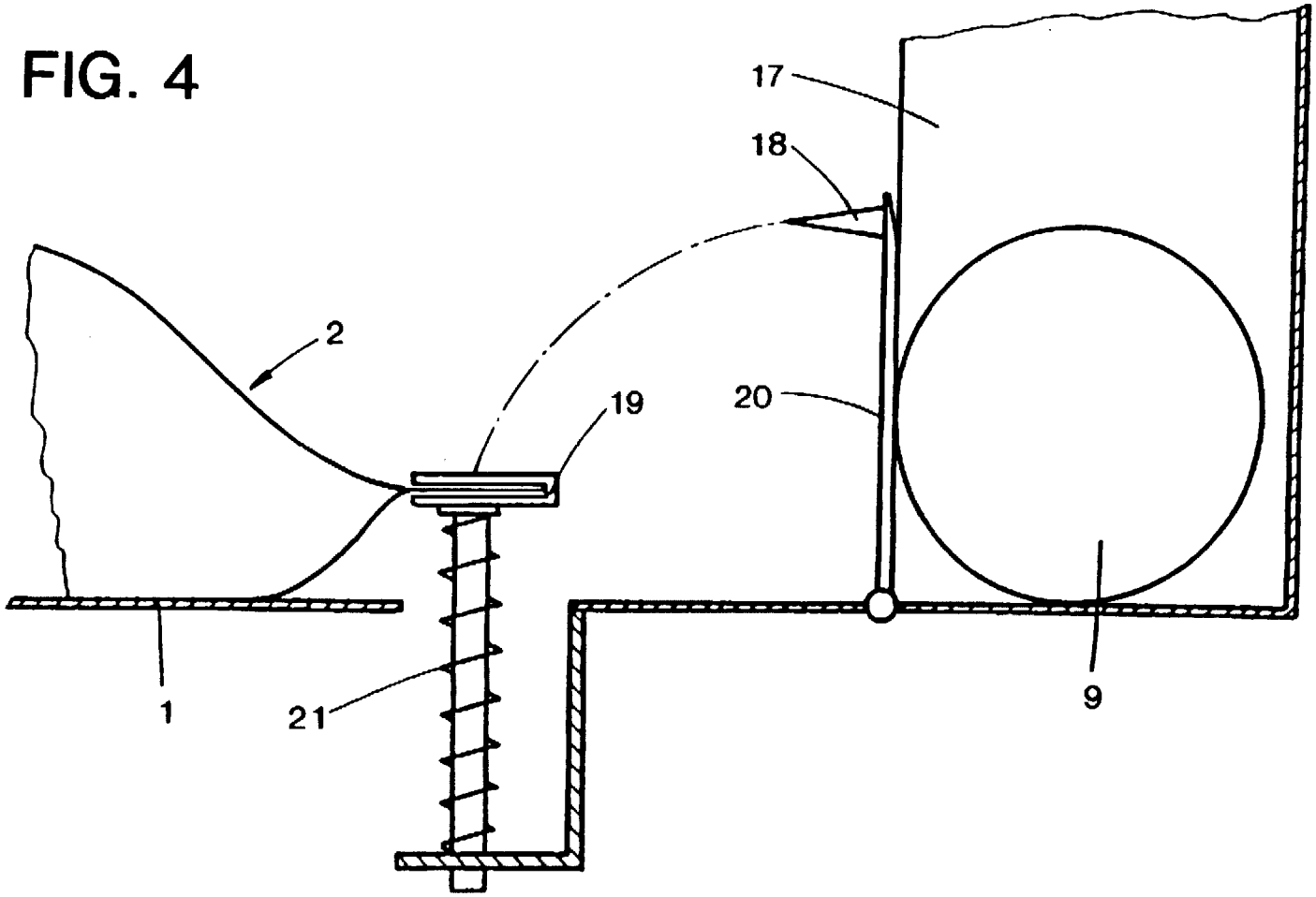
FIG. 4 shows the bag-end region in the removal unit illustrated in FIG. 3, on an enlarged scale, during the insertion of the weld seam end of a bag, filled with paste.

Before the bag 2 is introduced, the paste dispenser is in the position shown in FIG. 3. The cover 17 with the roller 9 and the spikes 18 is in the raised position. This region of the dispenser is shown on a larger scale in FIG. 4.

After the opening 4 of the bag has been connected to the delivery tube 3, the weld seam at the opposite end of the bag is placed in a clamp 19 consisting of two strips of metal lying one above the other. The bag 2 is thus fixed and connected in the paste dispenser and the cover 17 can be lowered. The roller 9 rolls out of the open box formed by the metal plate 20 and the walls of the cover into its starting position, and then down the inclined plate, shears the thixotropic paste which "liquefies" in this vicinity and, at the same time, squeezes it towards the opening of the bag. The spikes 18 penetrate into the weld seam of the bag 2 at corresponding recesses of the clamp 19. A compression spring 21 provided beneath the clamp 19 provides the necessary counter pressure.

Figure 5:
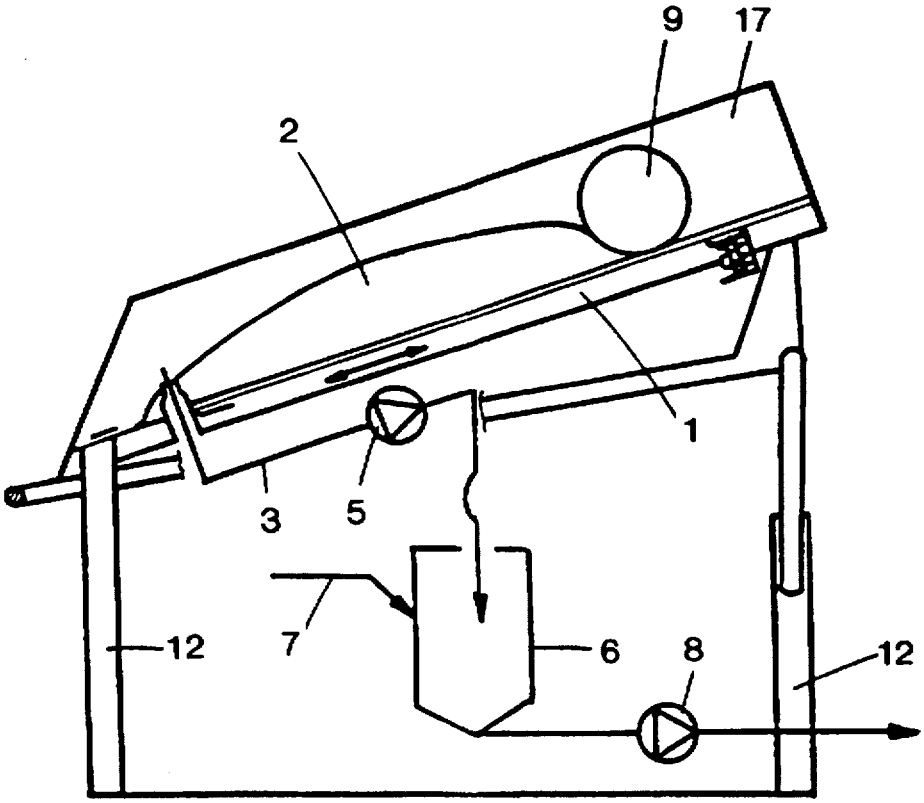
FIG. 5 is the same schematic illustration of the removal unit as FIG. 3 after the insertion of a bag, and with the roller moved into operative position.
Figure 6:
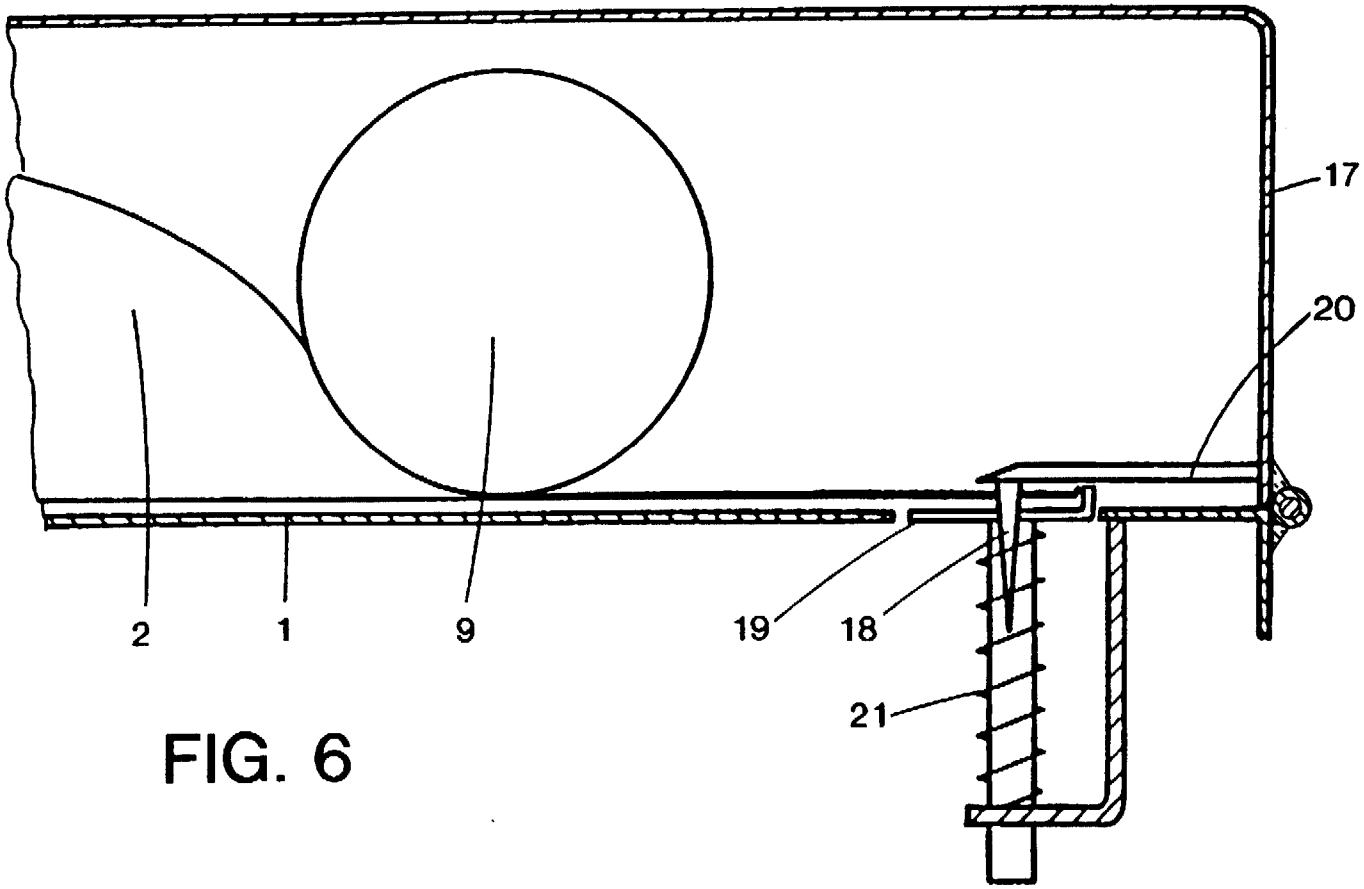
FIG. 6 shows the bag-end region in the removal unit illustrated in FIG. 5, on an enlarged scale.

This position of the paste dispenser is shown in FIGS. 5 and 6 where the same reference numerals have the same meanings as they do in the other figures.

When the cover 17 is in its raised position, the clamp 19 is located above the inclined plate 1, although it may also be moved towards the inclined plate 1. The clamp 19 thus follows the movement of the weld seam and the walls of the bag towards the inclined plate as the roller 9 passes over the bag.

The pivoting drive for the inclined plate and the cover indicated in FIG. 5 is shown more clearly in FIGS. 7 and 8. FIG. 7 schematically illustrates the pivoting drive before introduction of the paste-filled bag. In the interests of clarity, only the base frame 12 and the inclined plate 1 have been shown. The inclined plate 1 is fixed to the left-hand members of the base frame 12 by a universal joint which is indicated by an "X" and "+" symbol in FIG. 7. On the right-hand side, the plate 1 lies on the base frame 12. A pivotal arm 22 with a hand lever 23 rigidly connected thereto is mounted for rotation both on the inclined plate 1 and on a stay 24 which in turn is rotatably connected to the base frame 12. When the operator presses the hand lever 23 to left, the inclined plate 1 is pivoted together with the cover from the position shown in FIG. 7 into the position shown in FIG. 8 which is the working position. The roller situated in the right-hand part of the cover (not shown) rolls out of the cover onto the inclined plate. At the same time, the spikes penetrate into the weld seam of the bag, as explained above.

In order to damp the pivoting movement, a gas pressure spring 25 is provided between the stay 24 and the base frame 12. It enables the inclined plate to descend slowly into its working position after the upper dead point has been passed.

Alternatively, the pivoting drive may also be pneumatically operated. The extra cost is minimal because a compressed air source is present in most laundries.

LIST OF REFERENCE NUMERALS

1 Inclined plate, supporting surface
2 Bag
3, 3' Delivery tube
4 Opening of the bag, spout
5, 5' Eccentric screw pump, metering pump
6 Mixing container
7 Additional tube
8 Second pump
9 Roller
10 Upper bag wall
11 Lower bag wall
12 Baseframe
13 Conductivity sensor
14 Indicator
15 Opening
16 Plate
17 Cover
18 Spike
19 Lay-on plate or clamp
20 Metal plate
21 Compression spring
22 Pivotal arm
23 Hand lever
24 Stay
25 Gas pressure spring

What is claimed is:

1. A process for emptying a substantially completely compressible container (2) filled with a paste, in which, beginning at one end of said container (2), a compressive force is applied to the outside of said container (2) so that shear forces are applied to said paste, and one wall (10) of said container (2) is moved toward the opposite wall (11) of said container (2) so that said paste is transported by compression of said container (2) toward an opening (4) of said container (2) and through that opening into a connected delivery tube (3,3') leading to a mixing container (6), wherein said compressive force is applied to a limited area of said container (2) is moved towards the opening (4) and in that said paste is thixotropic and is a detergent and is transported by a metering pump (5,5') through said delivery tube (3,3') to said mixing container (6) where it is mixed with inflowing water.

2. The process of claim 1, wherein said shear forces are applied to said paste and said paste is pressed toward said opening (4) by means of a roller (9).

3. A removal unit for removing and metering paste from a flexible container (2), preferably in the form of a disposable bag provided with an opening (4), said removal unit comprising a baseframe (12) and means (9) for applying a compressive force to said flexible container (2) and hence shear forces to said paste by compression of said flexible container (2) beginning at one end thereof;

wherein said paste is a thixotropic detergent and said removal unit comprises means displaceable towards said opening (4) for compressing said flexible container (2) over a limited area so that said shear forces act on the said paste in said limited area and, at the same time, said paste is transported towards said opening (4).

4. The removal unit of claim 3, wherein said means (9) for applying said shear forces to said paste are in the form of a roller (9) designed to move towards said opening (4) of said flexible container (2) and, at the same time, designed to press walls (10,11) of said flexible container (2) together.

5. The removal unit of claim 4, further comprising:

an inclined plate (1) designed to accommodate said flexible container (2), which is connected to said opening (4) of said flexible container (2) at a lower end of said inclined plate (1), and a freemoving roller (9) sufficiently wide and heavy to press said walls (10, 11) of said flexible container (2) together.

6. The removal unit of claim 3 further comprising a delivery tube (3,3') for said paste connected to said flexible container (2) through an inlet opening of said delivery tube (3,3'), wherein a connecting element of said inlet opening of said delivery tube (3,3'), is releasably but sealingly connected to said opening (4) of said flexible container (2).

7. The removal unit of claim 5 further comprising an undercut at said opening (4) of said flexible container (2), wherein a plate (16) is fixed to said removal unit, and is inserted into said undercut.

8. The removal unit of claim 5, wherein spikes (18) are arranged at an end of said removal unit opposite said opening (4) for fixing said flexible container (2) in said removal unit.

9. The removal unit of claim 8, wherein a lay-on plate (19) is located at an end of said flexible container (2), and is situated at a distance from said inclined plate (1) of said removal unit, and near an end opposite said opening (4), and is provided with one or more spikes (18), and is designed to move towards said inclined plate (1) with progressive emptying of said flexible container (2).

10. The removal unit of claim 9, wherein said lay-on plate (19) is fixed by springs (21) to said inclined plate (1) for said flexible container (2).

11. The removal unit of claim 3 wherein a pump (5,5') in said delivery tube (3,3') is fixedly connected to said inclined plate (1) or to said baseframe (12).

12. The removal unit of claim 11, wherein said pump (5,5') is an eccentric screw pump (5,5').

13. The removal unit of claim 9, further comprising means for maintaining a distance between said walls (10,11) of said flexible container (2) in the vicinity of an inlet opening (15) of a delivery tube (3,3').

14. The removal unit of claim 3, wherein said flexible container (2) has a supporting surface in the form of an inclined plate (1), and said removal unit further comprises:

means for moving spikes (18) towards a lay-on plate (19) at an end of said flexible container (2); and a holder for said roller (9) to enable said roller (9) to be released when said spikes (18) are moved towards said lay-on plate (19).

15. The removal unit of claim 14, further comprising means (22, 23, 24) for pivoting said inclined plate (1) to a required inclination designed for actuation simultaneously with movement of said spikes (18) and the release of said roller (9).

16. The removal unit of claim 3, wherein a pump (5,5') is fixed to said baseframe (12).

17. The removal unit of claim 6, wherein said inlet opening (15) of said delivery tube (3,3') is designed for displacement relative to an inclined surface (1), optionally together with a connected pump (5,5').

18. The removal unit of claim 14, wherein said holder for said roller (9) is an open box (17,20).

19. The removal unit of claim 3, wherein said delivery tube (3,3') for said paste opens into a mixing container (6), wherein said mixing container (6) has a water inlet (7), and a conductivity sensor (13) is connected to an outlet of said mixing container (6) and is linked to an indicator (14).

20. A method for emptying a substantially completely compressible container (2) filled with a paste utilizing a removal unit, wherein, beginning at one end of said container (2), a compressive force is applied to the outside of the said container (2) so that shear forces are applied to said paste and one wall (10) of said container is moved towards and up to an opposite wall (11) of said container (2) so that said paste is transported by compression of said container (2) towards an opening (4) of said container (2) and through said opening (4) into a connected delivery tube (3,3') leading to a mixing container (6);

wherein said compressive force is applied to a limited area of said container (2) and is moved towards said opening (4);

wherein said paste is thixotropic and is a detergent and is transported by a metering pump (5,5') through said delivery tube (3,3') to said mixing container (6) where it is mixed with inflowing water;

wherein said container (2) has an undercut at said opening (4), and a plate (16) is inserted into said undercut and is fixed to said removal unit;

wherein spikes (18) are arranged at an end of said removal unit opposite said opening (4) for fixing said container (2) in said removal unit;

wherein a lay-on plate (19) at an end of said container (2) is situated at a distance from a supporting surface (1) of said removal unit and near an end opposite of said opening (4) and is provided with one or more spikes (18), being designed to move towards said supporting surface (1) with progressive emptying of said container (2); and further comprising means for maintaining a distance between walls (10,11) of said container (2) in the vicinity of said inlet opening (15) of said delivery tube (3,3').

21. The method of claim 20 wherein said shear forces are applied to said paste, and said paste is pressed towards said opening (4) by means of a roller (9);

wherein said plate (19) is fixed by springs (21) to said supporting surface (1) for said container (2);

wherein a pump (5,5') for said delivery tube (3,3') is fixedly connected to said supporting surface (1) or to a baseframe (12);

wherein said pump (5,5') is an eccentric screw pump (5,5');

wherein said inlet opening (15) of said delivery tube (3,3') is designed for displacement relative to said supporting surface (1), optionally together with said pump (5,5');

wherein a holder for said roller (9) is in the form of an open box (17,20); and wherein said mixing container (6) has a water inlet (7), and a conductivity sensor (13) is connected to said outlet of said mixing container (6) and is linked to an indicator (14).

22. A removal unit for removing and metering paste from a flexible container (2), preferably in the form of a disposable bag, provided with an opening (4), the unit comprising:

a baseframe (12) and means (9) for applying a compressive force to said flexible container (2) and hence shear forces to said paste by compression of said flexible container (2), beginning at one end thereof;

wherein said paste is a thixotropic detergent and said removal unit comprises means displaceable towards said opening (4) for compressing said flexible container (2) over a limited area so that shear forces act on said paste in said limited area and, at the same time, said paste is transported towards said opening (4); and wherein said means (9) for applying said shear forces to said paste is in the form of a roller (9) designed to move towards said opening (4) of said flexible container (2) and, at the same time, to press the walls of said flexible container (2) together; and an inclined plate (1) designed to accommodate said flexible container (2) with a connection to said opening (4) of said flexible container (2) at the lower end of said inclined plate (1), and a freemoving roller (9) sufficiently wide and heavy to press said walls (10,11) of said flexible container (2) together; and a delivery tube (3,3') for said paste connected to said flexible container (2) through an inlet opening, wherein a connecting element of said inlet opening of said delivery tube (3,3') is designed to be releaseably but sealingly connected to said opening (4) of said flexible container (2).

23. The removal unit of claim 22, further comprising an undercut at said opening (4) of said flexible container (2) and a plate (16) fixed to said removal unit and inserted into said undercut; and wherein spikes (18) are arranged at an end of said removal unit opposite said opening (4) for fixing said flexible container (2) in said removal unit.

24. The removal unit of claim 23 wherein a lay-on plate (19) for an end of said flexible container (2) is situated at a distance from a supporting surface (1) of said removal unit and near an end opposite of said opening (4), and is provided with one or more spikes (18), being designed to move towards said supporting surface (1) with progressive emptying of said flexible container (2);

wherein said lay-on plate (19) is fixed by springs (21) to said supporting surface (1) for said flexible container (2); and wherein a pump (5,5') in said delivery tube (3,3') is fixedly connected to said supporting surface (1) or to said baseframe (12).

25. The removal unit of claim 23 further comprising means for maintaining a distance between said walls (10,11) of said flexible container (2) in the vicinity of said inlet opening (15) of said delivery tube (3,3').

26. The removal unit of claim 23 further comprising:

a supporting surface for said flexible container (2) in the form on an inclined plate (1);

means for moving said spikes (18) towards a lay-on plate (19) at an end of said flexible container (2); and a holder for said roller (9) to enable said (9) roller to be released when said spikes (18) are removed towards said lay-on plate (19).

27. The removal unit of claim 26 further comprising:

means (22,23,24) for pivoting said inclined plate (1) to a required inclination, and designed for actuation simultaneously with the movement of said spikes (18) and the release of said roller (9).

28. The removal unit of claim 22 wherein said holder for said roller (9) is in the form of an open box (17,20);

wherein said inlet opening (15) of said delivery tube (3,3') is designed for displacement relative to said inclined plate (1), optionally together with a connected pump (5,5'); and wherein said delivery tube (3,3') for said paste opens into a mixing container (6), wherein said mixing container (6) has a water inlet (7), and a conductivity sensor (13) is connected to an outlet of said mixing container (6) and is linked to an indicator (14).

* * * * *